US011078005B1

(12) United States Patent
Kuo

(10) Patent No.: US 11,078,005 B1
(45) Date of Patent: Aug. 3, 2021

(54) PACKAGE CUSHIONING MATERIAL

(71) Applicant: Dongguan Wangquan Paper Products Co., Ltd., Guangdong (CN)

(72) Inventor: Sheng-Hsi Kuo, Guangdong (CN)

(73) Assignee: Dongguan Wangquan Paper Products Co., Ltd., Dongguan (CN)

( * ) Notice: Subject to any disclaimer, the term of this patent is extended or adjusted under 35 U.S.C. 154(b) by 0 days.

(21) Appl. No.: 17/098,575

(22) Filed: Nov. 16, 2020

Related U.S. Application Data

(63) Continuation of application No. PCT/CN2020/118483, filed on Sep. 28, 2020.

(51) Int. Cl.
*B65D 81/05* (2006.01)

(52) U.S. Cl.
CPC ..... *B65D 81/055* (2013.01)

(58) Field of Classification Search
CPC .. B65D 81/055; B65D 81/054; B65D 81/053; B65D 81/056; B65D 81/107; B65D 81/127; B65D 5/5069; A47G 23/0633
USPC ..... 206/565, 321, 325, 724, 728, 448, 206/453–455, 591, 586–588, 521, 523; 428/34.1
See application file for complete search history.

(56) References Cited

U.S. PATENT DOCUMENTS 1,783,570 A * 12/1930 Hill ..... B65D 5/5069 206/591
4,583,639 A * 4/1986 Fedick ..... B65D 85/48 206/325
4,700,844 A * 10/1987 Griffith ..... B65D 85/48 206/453
8,770,465 B2 * 7/2014 Rometty ..... B65D 81/055 229/5.5
2010/0072096 A1 * 3/2010 Wu ..... B65D 81/053 206/453
2010/0258474 A1 * 10/2010 Liu ..... B65D 81/055 206/587
2011/0183089 A1 * 7/2011 Kuo ..... B65D 85/48 428/34.1
2011/0220542 A1 * 9/2011 Kuo ..... B65D 5/5071 206/587

FOREIGN PATENT DOCUMENTS

CN 87210222 U 4/1988
CN 201793164 U 4/2011
CN 205770635 U 12/2016
CN 111056145 A 4/2020
JP 3136760 U * 11/2007 ..... B65D 81/053

* cited by examiner

*Primary Examiner* — Rafael A Ortiz

(57) ABSTRACT

The present application relates to the field of packaging structures, and more particularly to a package cushioning material. The package cushioning material includes a first buffer body and a second buffer body. The first buffer body is provided with a plug-in groove at one end thereof, the second buffer body is provided with a plug-in portion at one end thereof, and the plug-in portion is vertically connected to the plug-in groove and is bonded with the plug-in groove by a white latex. The first buffer body includes a first primary buffer body and a first secondary buffer body, and the first primary buffer body is arranged between two first secondary buffer bodies. The second buffer body includes a second primary buffer body and a second secondary buffer body, and the second primary buffer body is arranged between two second secondary buffer bodies.

14 Claims, 5 Drawing Sheets

PACKAGE CUSHIONING MATERIAL

CROSS-REFERENCE TO RELATED APPLICATION

The present application is a continuation of PCT application No. PCT/CN2020/118483 filed on Sep. 28, 2020. The entirety of the above-mentioned patent application is incorporated herein by reference and made a part of this specification.

BACKGROUND

Technical Field

The present application relates to the field of packaging structures, and more particularly, to a package cushioning material.

Description of Related Art

Electronic products are related products based on electric energy, and mainly include watches, smart phones, displays, computers, game machines, mobile communication products, and the like. Since most electronic products are precision industrial products, packaging design should consider that the packaging can withstand collision and impact of a certain external force during transportation, handling, and storage to prevent damage to the housing or machine core components.

Currently, commonly used package cushioning materials are generally made of foamed polystyrene (also known as expanded polystyrene, EPS), and the foamed polystyrene has the advantages of being small in relative density, low in heat conductivity, small in water absorption, resistant to shock and vibration, heat insulation, sound insulation, damp prevention, vibration reduction, excellent in dielectric property and the like. It is widely used in shockproof packaging materials for mechanical equipment, instruments, household electrical appliances, handicrafts, and other easily damaged valuable products, as well as fast food packaging. Waste foamed polystyrene plastics is light in weight and large in volume, and has the characteristics, such as resistance to aging and difficulty in corrosion, which becomes a major problem in garbage disposal. In addition, the package cushioning materials made of foamed polystyrene are difficult to recycle and reuse.

Accordingly, there remains a need in the art for a package cushioning material that is easy to recycle.

SUMMARY

In order to improve the problem that the packaging materials are difficult to recycle, the present application provides a package cushioning material, which has the effect of facilitating recycling.

The package cushioning material provided by this application adopts the technical solutions as follows.

There is provided a package cushioning material, which includes a first buffer body and a second buffer body, wherein, the first buffer body is provided with a plug-in groove at one end thereof, the second buffer body is provided with a plug-in portion at one end thereof, and the plug-in portion is vertically connected to the plug-in groove and is bonded with the plug-in groove by a water-soluble adhesive.

The first buffer body includes a first primary buffer body and a first secondary buffer body, wherein, the first primary buffer body is arranged between two first secondary buffer bodies, the first primary buffer body is provided with first connecting portions facing the end surfaces of the two first secondary buffer bodies, the first secondary buffer body is provided with second connecting portions connected to the first connecting portions, and the first connecting portion and the second connecting portion are bonded together by a water-soluble adhesive.

The second buffer body includes a second primary buffer body and a second secondary buffer body, wherein, the second primary buffer body is arranged between two second secondary buffer bodies, the second primary buffer body is provided with third connecting portions facing the end surfaces of the two second secondary buffer bodies, the second secondary buffer body is provided with fourth connecting portions connected to the third connecting portions, and the third connecting portion and the fourth connecting portion are bonded together by a water-soluble adhesive.

By adopting the above technical solution, the first buffer body and the second buffer body are bonded together by a water-soluble adhesive, thereby effectively reducing the recycling and disassembling steps and facilitating recycling. In some embodiments, the water-soluble adhesive is a white latex.

Preferably, the length of the first primary buffer body is less than the length of the first secondary buffer body, and two portions of the first secondary buffer body extending beyond the first primary buffer body form the plug-in groove.

The length of the second primary buffer body is more than the length of the second secondary buffer body, and two portions of the second primary buffer bodies extending beyond the second secondary buffer body form the plug-in portion.

The plug-in portion is vertically inserted into the plug-in groove, such that the second secondary buffer body abuts against the first secondary buffer body.

By adopting the above technical solution, the plug-in portion is vertically connected to the plug-in groove, so that the first buffer body and the second buffer body form an L-shaped structure.

Preferably, the first secondary buffer body and the second secondary buffer body have the same cross sections, and a first buffer cavity is provided in each of the first secondary buffer body and the second secondary buffer body.

By adopting the above technical solution, the first secondary buffer body and the second secondary buffer body can buffer the shock and vibration during transportation.

Preferably, the first primary buffer body and the second primary buffer body have the same cross sections, a second buffer cavity is provided in each of the first primary buffer body and the second primary buffer body, and the second buffer cavity is provided with a fixing groove toward one end surface of a packaged product.

By adopting the above technical solution, the first primary buffer body and the second primary buffer body can buffer the shock and vibration during transportation.

Preferably, a support is provided in the second buffer cavity, and an outer surface of the support abuts against an inner wall of the second buffer cavity and is bonded with the inner wall of the second buffer cavity by a water-soluble adhesive.

By adopting the above technical solution, the structural strength of the first primary buffer body and the second primary buffer body is effectively improved.

Preferably, the second buffer cavity is provided with a limiting groove away from an inner wall of the fixing groove, and one end of the support abuts against the limiting groove.

By adopting the above technical solution, the movement of the support in the second buffer cavity is effectively limited by the limiting groove.

Preferably, a buffer groove is provided on the surface of the support along the longitudinal direction of the support.

By adopting the above technical solution, the structural strength of the support is effectively improved.

Preferably, the buffer groove includes a first buffer groove and a second buffer groove, and a groove opening of the first buffer groove is wider than a groove opening of the second buffer groove.

By adopting the above technical solution, the deformation amplitude of the first buffer groove is made different from that of the second buffer groove.

Preferably, the first buffer groove is arranged on a supporting surface of the support and the second buffer cavity. The second buffer groove is arranged on a bonding surface of the support and the second buffer cavity.

By adopting the above technical solution, the impact resistance strength of the support is effectively improved, and the impact resistance strength of the second buffer cavity is effectively improved.

Preferably, the number of the support is two, the cross section of the support is a polygon, and the end face of the longest right-angle side of the support abuts against the inner wall of the second buffer cavity and is bonded with the inner wall of the second buffer cavity by a water-soluble adhesive. The end face of the shortest right-angle side of the support abuts against the inner wall of the second buffer cavity and is bonded with the inner wall of the second buffer cavity by a water-soluble adhesive, so that the support is connected to the second buffer cavity, thereby effectively improving the structural strength of the first primary buffer body and the second primary buffer body.

By adopting the above technical solution, the support is connected with the second buffer cavity, which effectively improves the structural strength of the first primary buffer body and the second primary buffer body.

In summary, the present application has at least one of the following beneficial technical effects:

1. The first buffer body and the second buffer body are bonded together by a water-soluble adhesive, thereby effectively reducing the recycling and disassembling steps and facilitating recycling.
2. The structural strength of the first primary buffer body and the second primary buffer body is effectively improved.

DESCRIPTION OF THE EMBODIMENTS

Hereinafter, this application will be explained in more detail with reference to the FIGS. 1-5.

Figure 1:
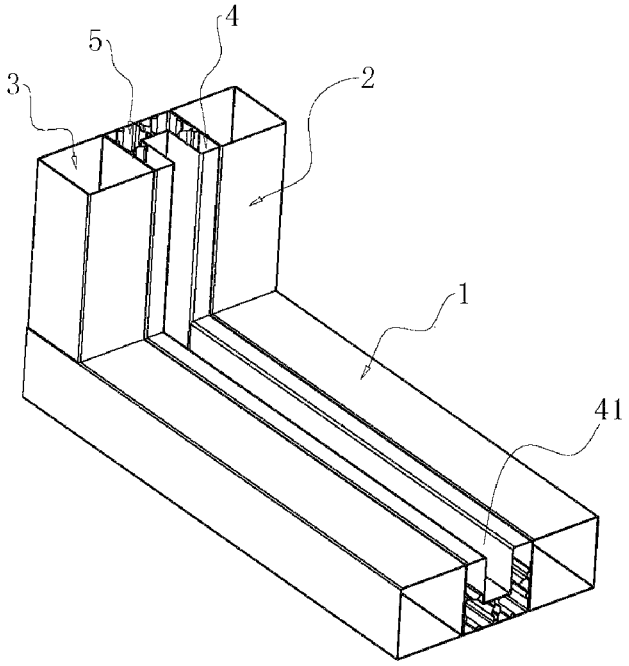
FIG. 1 is a perspective structural schematic diagram of a package cushioning material according to an embodiment.
Figure 2:
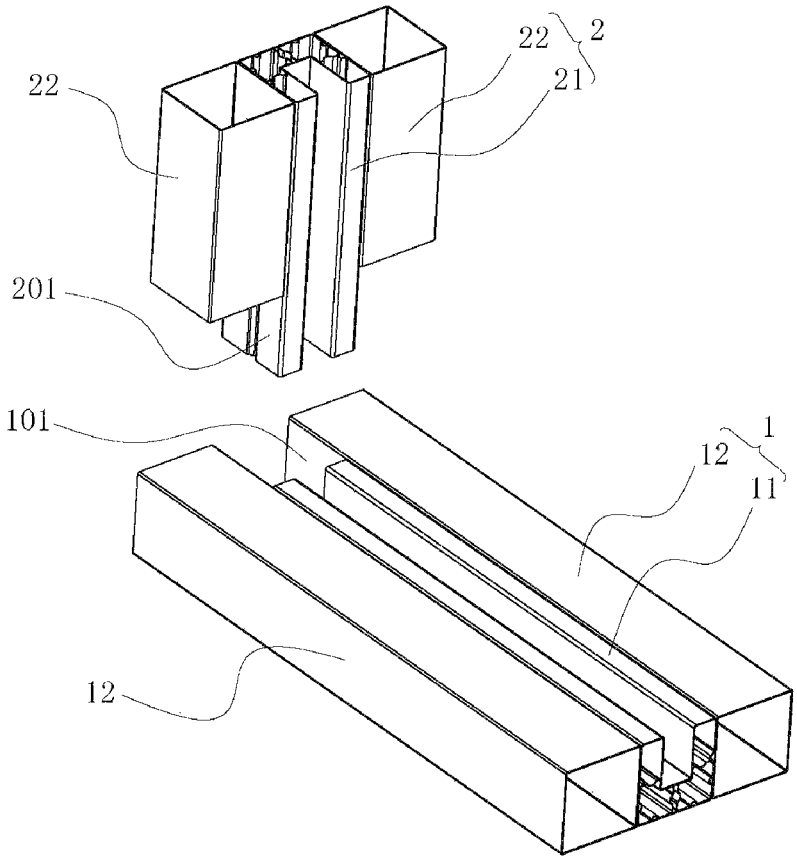
FIG. 2 is a structural schematic diagram of a first buffer body and a second buffer body of a package cushioning material according to an embodiment.
Figure 3:
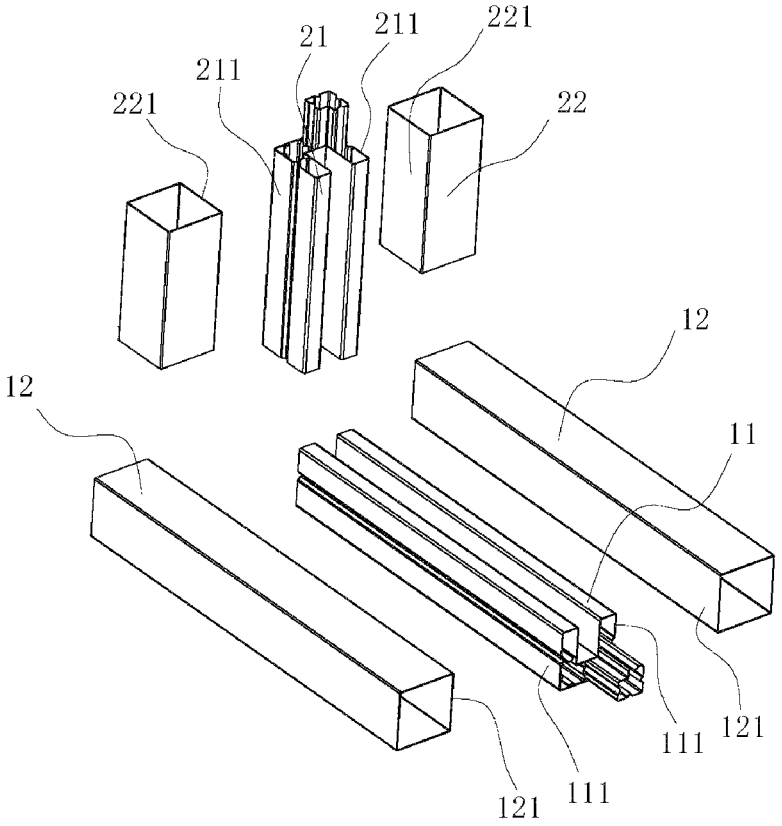
FIG. 3 is an exploded structural schematic diagram of a package cushioning material according to an embodiment.

Referring to FIGS. 1, 2 and 3, in one embodiment, the package cushioning material includes a first buffer body 1 and a second buffer body 2. The first buffer body 1 is provided with a plug-in groove 101 at one end thereof, and the second buffer body 2 is provided with a plug-in portion 201 at one end thereof. The plug-in portion 201 is vertically connected to the plug-in groove 101 and is bonded with the plug-in groove 101 by a water-soluble adhesive; so that the first buffer body 1 and the second buffer body 2 form an L-shaped structure to wrap the corners of the electronic product, thereby effectively absorbing the shock and vibration during transportation and effectively protecting the transportation of the electronic product. The water-soluble adhesive is a white latex such as a polyvinyl acetate adhesive or a polyacrylate emulsion adhesive. The first buffer body 1 and the second buffer body 2 are bonded together by a water-soluble adhesive without using other connectors to connect, thereby effectively reducing the recycling and disassembling steps and facilitating recycling.

The first buffer body 1 includes a first primary buffer body 11 and a first secondary buffer body 12. In one embodiment, the first primary buffer body 11 and the first secondary buffer body 12 are both kraft paper buffer bodies, which are robust, durable, attractive and environmentally friendly, and are easy to recycle.

The first primary buffer body 11 is arranged between two first secondary buffer bodies 12, the first primary buffer body 11 is provided with first connecting portions 111 facing the end surfaces of the two first secondary buffer bodies 12, the first secondary buffer body 12 is provided with second connecting portions 121 connected to the first connecting portions 111, the first connecting portion 111 and the second connecting portion 121 are bonded together by a water-soluble adhesive without using other connectors to connect, thereby effectively reducing the recycling and disassembling steps and facilitating recycling of the first buffer body 1.

The second buffer body 2 includes a second primary buffer body 21 and a second secondary buffer body 22. The second primary buffer body 21 and the second secondary buffer body 22 are both kraft paper buffer bodies, which are robust, durable, attractive and environmentally friendly, and are easy to recycle.

The second primary buffer body 21 is arranged between two second secondary buffer bodies 22. The second primary buffer body 21 is provided with third connecting portions 211 facing the end surfaces of the two second secondary buffer bodies 22. The second secondary buffer body 22 is provided with fourth connecting portions 221 connected to the third connecting portions 211. The third connecting portion 211 and the fourth connecting portion 221 are bonded together by a water-soluble adhesive without using other connectors to connect, thereby effectively reducing the recycling and disassembling steps and facilitating recycling of the second buffer body 2.

Referring to FIGS. 1 and 2, the length of the first primary buffer body 11 is less than that of the first secondary buffer body 12, and two portions of the first secondary buffer body 12 extending beyond the first primary buffer body 11 form the plug-in groove 101.

The length of the second primary buffer body 21 is more than that of the second secondary buffer body 22, and two portions of the second primary buffer bodies 21 extending beyond the second secondary buffer body 22 form the plug-in portion 201.

When the plug-in portion 201 is vertically inserted into the plug-in groove 101, the second secondary buffer body 22 abuts against the first secondary buffer body 12, so that the first buffer body 1 and the second buffer body 2 form an L-shaped structure, and the package cushioning material can wrap around the corners of the packaged electronic product.

Figure 4:
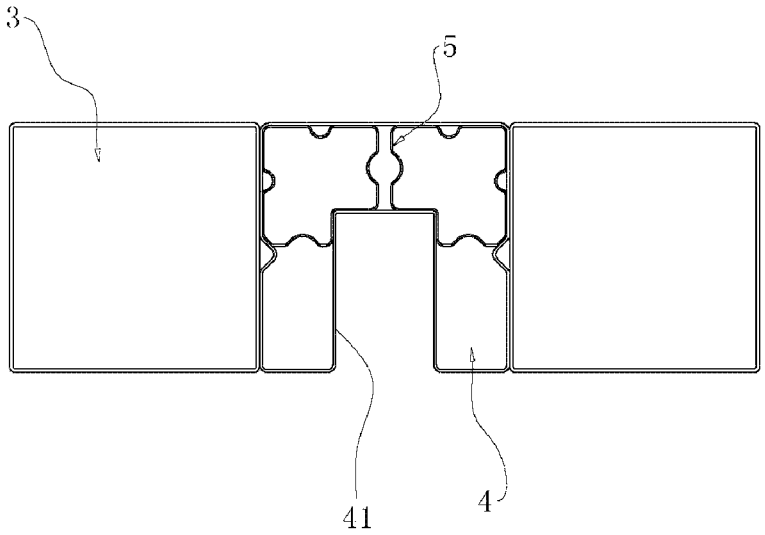
FIG. 4 is a structural schematic diagram showing cross sections of a first buffer cavity and a second buffer cavity of a package cushioning material according to an embodiment.

Referring to FIG. 4, the first secondary buffer body 12 and the second secondary buffer body 22 have the same cross sections. A first buffer cavity 3 is provided in each of the first secondary buffer body 12 and the second secondary buffer body 22. By means of the first buffer cavity 3, the first secondary buffer body 12 and the second secondary buffer body 22 can buffer the shock and vibration during transportation, thereby effectively protecting the transportation of the electronic product.

Preferably, the first secondary buffer body 12 and the second secondary buffer body 22 are both hollow square in cross section, so that the first secondary buffer body 12 and the second secondary buffer body 22 can buffer the shock and vibration during transportation, thereby effectively protecting the transportation of the electronic product. In other embodiments, the first secondary buffer body 12 and the second secondary buffer body 22 may also be semicircular or trapezoidal in cross section.

Referring to FIG. 4, the first primary buffer body 11 and the second primary buffer body 21 have the same cross sections. A second buffer cavity 4 is provided in each of the first primary buffer body 11 and the second primary buffer body 21. The second buffer cavity 4 is provided with a fixing groove 41 toward one end surface of a packaged product, so that the first primary buffer body 11 and the second primary buffer body 21 can buffer the shock and vibration during transportation by means of the second buffer cavity 4, thereby effectively protecting the transportation of the electronic product. Meanwhile, the fixing groove 41 is connected to the packaged electronic product for easy use.

Preferably, the first primary buffer body 11 and the second primary buffer body 21 are both concave in cross section, so as to buffer the shock and vibration during transportation, effectively protect the transportation of electronic products, and at the same time facilitate connection with the packaged electronic products.

Figure 5:
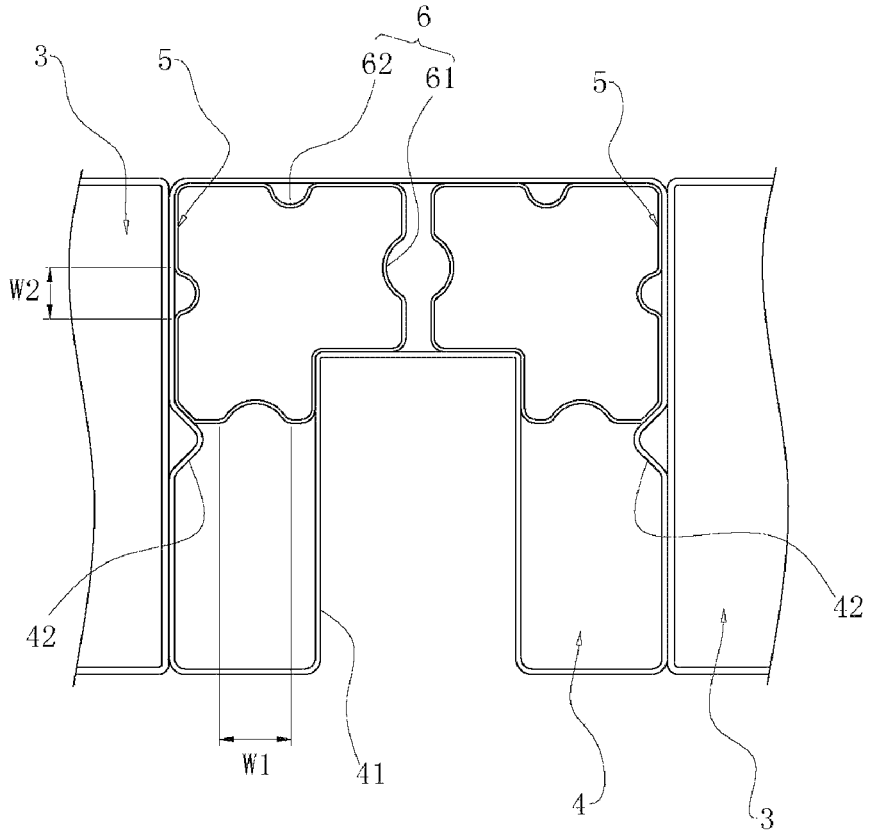
FIG. 5 is a structural schematic diagram showing cross sections of a buffer groove of a package cushioning material according to an embodiment.

Referring to FIGS. 4 and 5, a support 5 is provided in the second buffer cavity 4, and the support 5 may be one or more, and the structural strength of the first primary buffer body 11 and the second primary buffer body 21 is improved by the support 5.

At least two end surfaces of the external surface of the support 5 abut against the inner wall of the second buffer cavity 4 and are bonded together by a water-soluble adhesive, so as to connect the support 5 with the second buffer cavity 4.

Referring to FIG. 5, the second buffer cavity 4 is provided with a limiting groove 42 away from an inner wall of the fixing groove 41, and one end of the support 5 abuts against the limiting groove 42, and the movement of the support 5 in the second buffer cavity 4 is effectively limited by the limiting groove 42, and at the same time, the limiting groove 42 plays a role of fool-proofing on the support 5 when installed.

Referring to FIG. 5, a buffer groove 6 is provided on the surface of the support 5 along the longitudinal direction of the support 5, and the structural strength of the support 5 is improved by the buffer groove 6.

Preferably, the cross section of the buffer groove 6 is a C-shaped buffer groove, and the structural strength of the support 5 is improved by the C-shaped buffer groove. In other embodiments, the cross section of the buffer groove 6 is a V-shaped or S-shaped buffer groove.

Referring to FIG. 5, the buffer groove 6 includes a first buffer groove 61 and a second buffer groove 62, and a groove opening W1 of the first buffer groove 61 is wider than a groove opening W2 of the second buffer groove 62, making the deformation amplitude of the first buffer groove 61 greater than that of the second buffer groove 62.

Referring to FIG. 5, the first buffer groove 61 is arranged on a supporting surface of the support 5 and the second buffer cavity 4, effectively improving the deformation amplitude of the supporting surface of the support 5.

The second buffer groove 62 is arranged on a bonding surface of the support 5 and the second buffer cavity 4, effectively improving the impact force absorbing capacity of the bonding surface of the support 5 and the second buffer cavity 4.

Referring to FIG. 5, the number of the support 5 is two, the cross section of the support 5 is a hollow L-shaped structure, and the end face of the longest right-angle side of the support 5 abuts against the inner wall of the second buffer cavity 4 and is bonded with the inner wall of the second buffer cavity 4 by a water-soluble adhesive. The end face of the shortest right-angle side of the support 5 abuts against the inner wall of the second buffer cavity 4 and is bonded with the inner wall of the second buffer cavity by a water-soluble adhesive, so that the support 5 is connected to the second buffer cavity, thereby effectively improving the structural strength of the first primary buffer body 11 and the second primary buffer body 21.

The implementation principle of the package cushioning material in the embodiment of the present application is that: the first primary buffer body 11 and a first secondary buffer body 12 are bonded together by a water-soluble adhesive via the first connecting portion 111 and the second connecting portion 121 to form the first buffer body 1. The second primary buffer body 21 and the second secondary buffer body 22 are bonded together by a water-soluble adhesive via the third connecting portion 211 and the fourth connecting portion 221 to form the second buffer body 2. The plug-in portion 201 is vertically connected to the plug-in groove 101 and is bonded with the plug-in groove 101 by a water-soluble adhesive; so that the first buffer body 1 and the second buffer body 2 form an L-shaped structure to wrap the corners of the electronic product, thereby effectively absorbing the shock and vibration during transportation and effectively protecting the transportation of the electronic product. Meanwhile, the first buffer body 1 and the second buffer body 2 are bonded together by a water-soluble adhesive without using other connectors to connect, thereby effectively reducing the recycling and disassembling steps and facilitating recycling.

The above description is only preferred embodiments of the present application and is not intended to limit the protection scope of the present application. Therefore, all equivalent changes of the structure, shape or principle according to the spirit of the present application should be all included in the protection scope of the present application.

What is claimed is:

1. A package cushioning material, comprising: a first buffer body and a second buffer body, wherein:

the first buffer body is provided with a plug-in groove at one end thereof, the second buffer body is provided with a plug-in portion at one end thereof, and the plug-in portion is vertically connected to the plug-in groove and is bonded with the plug-in groove by a water-soluble adhesive, the first buffer body comprises a first primary buffer body and a first secondary buffer body, wherein, the first primary buffer body is arranged between two first secondary buffer bodies, the first primary buffer body is provided with first connecting portions facing the end surfaces of the two first secondary buffer bodies, the first secondary buffer body is provided with second connecting portions connected to the first connecting portions, the first connecting portion and the second connecting portion are bonded together by a water-soluble adhesive, and the second buffer body comprises a second primary buffer body and a second secondary buffer body, wherein, the second primary buffer body is arranged between two second secondary buffer bodies, the second primary buffer body is provided with third connecting portions facing the end surfaces of the two second secondary buffer bodies, the second secondary buffer body is provided with fourth connecting portions connected to the third connecting portions, the third connecting portion and the fourth connecting portion are bonded together by a water-soluble adhesive.

2. The package cushioning material according to claim 1, wherein, a length of the first primary buffer body is less than a length of the first secondary buffer body, and two portions of the first secondary buffer body extending beyond the first primary buffer body form the plug-in groove, a length of the second primary buffer body is more than a length of the second secondary buffer body, and two portions of the second primary buffer bodies extending beyond the second secondary buffer body form the plug-in portion, and the plug-in portion is vertically inserted into the plug-in groove, such that the second secondary buffer body abuts against the first secondary buffer body.

3. The package cushioning material according to claim 1, wherein, the first secondary buffer body and the second secondary buffer body have the same cross sections, and a first buffer cavity is provided in each of the first secondary buffer body and the second secondary buffer body.

4. The package cushioning material according to claim 1, wherein, the first primary buffer body and the second primary buffer body have the same cross sections, a second buffer cavity is provided in each of the first primary buffer body and the second primary buffer body, and the second buffer cavity is provided with a fixing groove toward one end surface of a packaged product.

5. The package cushioning material according to claim 4, wherein, a support is provided in the second buffer cavity, and an outer surface of the support abuts against an inner wall of the second buffer cavity and is bonded with the inner wall of the second buffer cavity by a water-soluble adhesive.

6. The package cushioning material according to claim 5, wherein, the second buffer cavity is provided with a limiting groove away from an inner wall of the fixing groove, and one end of the support abuts against the limiting groove.

7. The package cushioning material according to claim 5, wherein, a buffer groove is provided on the surface of the support along the longitudinal direction of the support.

8. The package cushioning material according to claim 7, wherein, the buffer groove comprises a first buffer groove and a second buffer groove, and a groove opening of the first buffer groove is wider than a groove opening of the second buffer groove.

9. The package cushioning material according to claim 8, wherein, the first buffer groove is arranged on a supporting surface of the support and the second buffer cavity, the second buffer groove is arranged on a bonding surface of the support and the second buffer cavity.

10. The package cushioning material according to claim 5, wherein, the number of the support is two, the cross section of the support is a polygon, and the end face of the longest right-angle side of the support abuts against the inner wall of the second buffer cavity and is bonded with the inner wall of the second buffer cavity by a water-soluble adhesive, the end face of the shortest right-angle side of the support abuts against the inner wall of the second buffer cavity and is bonded with the inner wall of the second buffer cavity by a water-soluble adhesive.

11. The package cushioning material according to claim 6, wherein, the number of the support is two, the cross section of the support is a polygon, and the end face of the longest right-angle side of the support abuts against the inner wall of the second buffer cavity and is bonded with the inner wall of the second buffer cavity by a water-soluble adhesive, the end face of the shortest right-angle side of the support abuts against the inner wall of the second buffer cavity and is bonded with the inner wall of the second buffer cavity by a water-soluble adhesive.

12. The package cushioning material according to claim 7, wherein, the number of the support is two, the cross section of the support is a polygon, and the end face of the longest right-angle side of the support abuts against the inner wall of the second buffer cavity and is bonded with the inner wall of the second buffer cavity by a water-soluble adhesive, the end face of the shortest right-angle side of the support abuts against the inner wall of the second buffer cavity and is bonded with the inner wall of the second buffer cavity by a water-soluble adhesive.

13. The package cushioning material according to claim 8, wherein, the number of the support is two, the cross section of the support is a polygon, and the end face of the longest right-angle side of the support abuts against the inner wall of the second buffer cavity and is bonded with the inner wall of the second buffer cavity by a water-soluble adhesive, the end face of the shortest right-angle side of the support abuts against the inner wall of the second buffer cavity and is bonded with the inner wall of the second buffer cavity by a water-soluble adhesive.

14. The package cushioning material according to claim 9, wherein, the number of the support is two, the cross section of the support is a polygon, and the end face of the longest right-angle side of the support abuts against the inner wall of the second buffer cavity and is bonded with the inner wall of the second buffer cavity by a water-soluble adhesive, the end face of the shortest right-angle side of the support abuts against the inner wall of the second buffer cavity and is bonded with the inner wall of the second buffer cavity by a water-soluble adhesive.

* * * * *